United States Patent [19]

Castonguay et al.

[11] 4,344,054

[45] Aug. 10, 1982

[54] LATCH ASSEMBLY FOR STATIC TRIP CIRCUIT BREAKERS

[75] Inventors: Roger N. Castonguay, Terryville; Charles L. Jencks, Avon; Peter P. Clickner, Bristol, all of Conn.

[73] Assignee: General Electric Company, New York, N.Y.

[21] Appl. No.: 240,442

[22] Filed: Mar. 4, 1981

[51] Int. Cl.[3] ..... H01H 73/02; H01H 75/02

[52] U.S. Cl. ..... 335/169; 335/22; 335/167

[58] Field of Search ..... 335/167, 168, 169, 170, 335/171, 172, 173, 174, 20, 21, 22; 200/153 G

[56] References Cited

U.S. PATENT DOCUMENTS 4,001,742 1/1977 Jencks et al. ..... 337/173

*Primary Examiner*—Harold Broome

*Attorney, Agent, or Firm*—Richard A. Menelly; Walter C. Bernkopf; Fred Jacob

[57] ABSTRACT

A pivotally mounted primary latch lever carries a latch pin for latchingly engaging a cradle to sustain it in a reset position against the bias of the breaker mechanism operating springs. An intermediate latch lever, pivotally mounted to the primary latch lever, is formed with a pair of latch shoulders for respective latching engagement with a pair of latch pins associated with a pivotally mounted secondary latch lever. The geometry of the latch assembly parts and their various latching engagements are such that an exceptionally light trip initiating force on the secondary latch lever is effective in releasing the cradle from its reset position.

4 Claims, 4 Drawing Figures

LATCH ASSEMBLY FOR STATIC TRIP CIRCUIT BREAKERS

BACKGROUND OF THE INVENTION

The present invention relates to circuit breaker latch assemblies and particularly to an improved latch assembly for static trip circuit breakers.

In commonly assigned U.S. Pat. No. 4,001,742, there is disclosed a static trip, three-pole industrial circuit breaker to which the present invention has particular but not necessarily limited application. The latch assembly of this patent disclosure includes interacting primary and secondary latch levers for sustaining the cradle of the breaker operating mechanism in its latched reset position against the bias of charged mechanism springs. As long as this cradle reset position is sustained, the breaker operating mechanism may be articulated such as to motivate the breaker movable contacts to a stable closed circuit position. To then open the breaker contacts, the secondary latch lever is actuated, either manually or automatically via a trip solenoid activated under the control of a static trip unit in response to a sensed overcurrent condition, to release the primary latch lever; the latter then releasing the cradle from its reset position. While this two stage latch assembly arrangement was generally effective, the tolerances imposed on the various latching surfaces were found to be quite stringent and, unless these tolerances were strictly observed, the requisite trip actuating force to be exerted on the secondary latch lever by the trip solenoid became unduly great.

It is accordingly an object of the present invention to provide an improved latch assembly for static trip circuit breakers.

An additional object is to provide a latch assembly of the above character which accommodates less stringent manufacturing tolerances.

A further object is to provide a latch assembly of the above character which accommodates a relatively light trip actuating force.

Yet another object is to provide a latch assembly of the above character which is efficient in construction, economical to manufacture, and reliable in operation.

Other objects of the invention will in part be obvious and in part appear hereinafter.

SUMMARY OF THE INVENTION

In accordance with the present invention, there is provided an improved latch assembly for static trip industrial circuit breakers. Basically, the subject latch assembly is a three stage latch mechanism including a primary latch lever, an intermediate latch lever and a secondary latch lever, all interacting to latchingly sustain the pivotally mounted cradle of a circuit breaker operating mechanism in an untripped or reset position against the bias of charged mechanism springs.

More specifically, the primary latch lever is pivotally mounted adjacent its one end on a first pivot pin and carries adjacent its other end a primary latch pin adapted to latchingly engage a primary latch shoulder formed in the cradle pursuant to releasably sustaining the latter in its reset position. The primary latch lever also carries, intermediate its ends, a second pivot pin for pivotally mounting one end of the intermediate latch lever. At the other end of the intermediate latch lever there is formed an intermediate latch shoulder and a secondary latch shoulder. The secondary latch lever provides an intermediate latch pin which, in the disclosed embodiment, is constituted by an extension of a third pivot pin pivotally mounting the secondary latch. This intermediate latch pin is adapted to engage the intermediate latch shoulder of the intermediate latch lever, while a secondary latch pin, carried by the secondary latch lever, is adapted to engage the secondary latch shoulder of the intermediate latch lever.

The geometries of the various pivotally mounted latch levers, latch shoulders and latch pins are such that the rather large moment exerted on the primary latch lever by the force of the breaker mechanism springs acting through the cradle is ultimately counteracted by an exceptionally light force imposed at the engagement of the secondary latch pin with the secondary latch shoulder.

This light counteracting force creates a correspondingly light frictional force which can readily be overcome by a relatively modest tripping force applied, for example, by a trip solenoid to the secondary latch lever in a manner to effect disengagement of the secondary latch pin from the secondary latch shoulder. With this disengagement, the intermediate latch pin and intermediate latch shoulder also disengage to remove the pivotal restraint imposed on the primary latch lever by the intermediate latch lever. The cradle is then freed to push the primary latch pin out of its path of swinging movement from its reset position to its tripped position under the urgence of the discharging mechanism springs. Coincidentally, the discharging mechanism springs abruptly propel the breaker movable contacts from their closed circuit positions to their open circuit positions.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings in which:

DESCRIPTION OF THE DRAWINGS

Corresponding reference numerals refer to like parts throughout the several views of the drawings.

DETAILED DESCRIPTION

Figure 1:
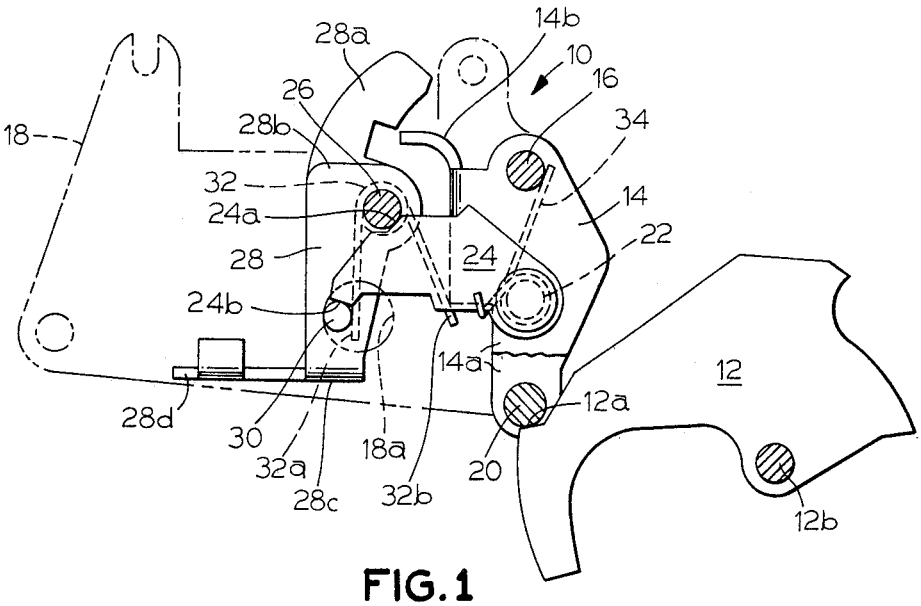
FIG. 1 is a side elevational view of a circuit breaker latch assembly constructed in accordance with the present invention.

Referring first to FIG. 1, the latch assembly of the present invention, generally indicated at 10, is illustrated in its application latchingly sustaining a cradle 12 of a spring-powered circuit breaker operating in the untripped or reset position shown. For a detailed description of an applicable breaker operating mechanism, reference may be had to the above-noted U.S. Pat. No. 4,001,742, the disclosure of which is specifically incorporated herein by reference. Latch assembly 10 includes a primary latch lever 14 which is pivotally mounted adjacent its upper end by a pin 16 in turn transversely mounted between a pair of parallel, spaced side plates illustrated in phantom at 18. In practice, primary latch lever 14 may be U-shaped in transverse cross-section such as to provide a pair of identical lever arms 14*a* joined by a bight portion 14*b*.

Carried by the lower end portion of the primary latch lever is a transverse primary latch pin 20 for engaging a primary latch shoulder 12*a* formed in the edge of the cradle tail end portion. The primary latch lever also carries, at a location intermediate its ends, a pivot pin 22 for pivotally mounting one end of an intermediate latch lever 24. At its other end, the intermediate latch lever is formed to provide an intermediate latch shoulder 24*a* and a separate secondary latch shoulder 24*b*. In the cradle latching condition of latch assembly 10, intermediate latch shoulder 24*a* engages an intermediate latch pin 26 which preferably is constituted by an extension of a shaft mounted transversely between side plates 18 and serving to pivotally mount a secondary latch lever 28. Mounted adjacent the lower end of secondary latch lever is a secondary latch pin 30 in position to engage secondary latch shoulder 24*b* of the intermediate latch lever while the latch assembly is in its loaded or cradle latching condition. The secondary latch lever is also preferably U-shaped having a pair of lever arms 28*a* and 28*b* integrally joined at their lower ends by a transverse bight portion 28*c* having a longitudinal extension to serve as a trip actuating arm 28*d*. Completing the description of the latch assembly parts seen in FIG. 1, a double acting torsion spring 32 is carried on intermediate latch pin 26 with one end 32*a* thereof engaging secondary latch pin 30 to bias secondary latch lever 28 to its illustrated, unactuated, clockwise-most position determined by the abutment of the secondary latch pin against the edges of enlarged openings 18*a* in side plates 18 through which the ends of the secondary latch pin project. The other end 32*b* of this spring acts to bias primary latch lever 14 in the counterclockwise direction such as to resiliently urge primary latch pin 20 into intercepting relation with primary latch shoulder 12*a* when cradle 12 is swung in the counterclockwise direction about its pivotal mounting shaft 12*b* from its tripped position to its illustrated reset position incident with a breaker resetting function. Finally, a torsion spring 34 is carried on pivot pin 22 and acts between pivot pin 16 and intermediate latch lever 24 to assist in controlling the position of the intermediate latch lever during latch assembly reset, as will be detailed below.

Figure 2:
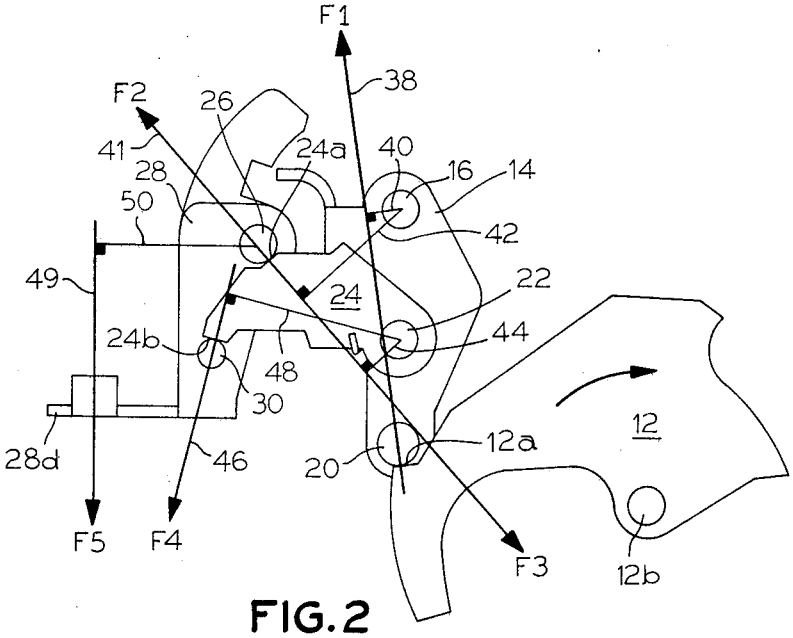
FIG. 2 is a simplified side elevational view of the latch assembly of FIG. 1 illustrating the various rotational moments imposed on the latch assembly parts while releaseably sustaining the cradle of a spring-powered breaker operating mechanism in its reset position.

Having described the latch assembly parts in connection with FIG. 1, reference is now had to FIG. 2 for an analysis of the forces involved in sustaining the cradle in its reset position. As can be observed from the disclosure of the above-noted patent, the charged breaker operating mechanism springs exert a torque on the cradle attempting to swing it away from its reset position in the clockwise direction about its pivotal mounting shaft 12*b*, as seen in FIG. 2. With primary latch pin 20 engaging primary latch shoulder 12*a* to sustain the cradle in its reset position, the charged mechanism springs exert, by virtue of the bias angle imparted to the primary latch shoulder, a clockwise moment on primary latch lever 14. This moment, exerted about pivot pin 16, is composed of a force F1 having a line of force 38 and a relatively short arm 40. Since the angular relationship of intermediate latch lever 24 with the primary latch lever is effectively fixed by the engagements of its latch shoulders 24*a* and 24*b* with pins 26 and 30, the clockwise moment on the primary latch lever associated with force F1 is transposed to a clockwise moment on the primary latch lever about pin 16 composed of a force F2 having a line of force 41 and a moment arm 42. Note that moment arm 42 is considerably longer than moment arm 40, and thus the magnitude of force F2 is proportionately less than the magnitude of force F1.

Force F2 is opposed by an equal and oppositely directed force F3 which exerts a counterclockwise moment on intermediate latch lever 24 about pin 22 having a moment arm 44. It is seen that moment arm 44 is considerably shorter than moment arm 42, and thus the counterclockwise moment on intermediate latch lever 24 is proportionately less than, and yet effectively counter-balances, the clockwise moment exerted on the primary latch lever by the charged breaker mechanism springs. By virtue of the engagement of secondary latch shoulder 24*b* with secondary latch pin 30, the counterclockwise moment on the intermediate latch lever by force F3 is transposed to a counterclockwise moment thereon exerted about pin 22 composed of a force F4 having a line of force 46 and a moment arm 48. Since moment arm 48 is seen to be considerably longer than moment arm 44, force F4 is proportionately smaller than force F3. Thus, the mechanical advantage built into latch assembly 10 enables the very light force F4 to effectively oppose the large force F1 and thus sustain cradle 12 in its reset position. By the same token, this light secondary latch force F4 is indicative of a low frictional resistance to disengaging secondary latch pin 30 from secondary latch shoulder 24*b* pursuant to initiating a trip function. Thus, an exceptionally low trip force such as indicated at F5 applied to actuating arm 28*d* along line of force 49 can exert sufficient counterclockwise moment on secondary latch lever 28, particularly considering the length of moment arm 50, to swing the secondary latch pin rightward out from under the secondary latch shoulder. It will be noted that, while the trip force F5 exerted on the secondary latch lever is opposed by spring 32 (FIG. 1), it is aided by the counterclockwise moment exerted on the secondary latch lever by force F4.

Figure 3:
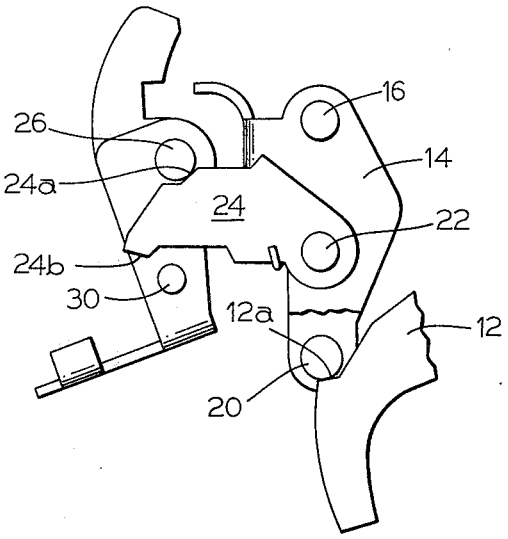
FIG. 3 is a simplified side elevational view of the latch assembly of FIG. 1 with the parts thereof shown in their positions assumed in response to the initiation of a breaker trip function.
Figure 4:
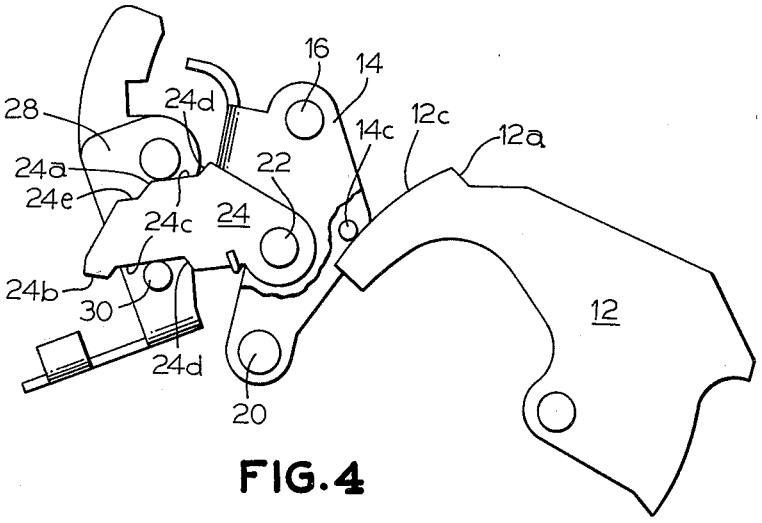
FIG. 4 is a simplified side elevational view of the latch assembly of FIG. 1 with the parts thereof shown in their positions assumed after the release of the cradle from its reset position.

From FIG. 3, it is seen that when secondary lever 28 is pivoted in the counterclockwise direction by trip force F5 developed by a trip solenoid (not shown), secondary latch pin 30 is swung rightward out from under secondary latch shoulder 24*b*. The counterclockwise moment on intermediate latch lever 24 by force F4 (FIG. 2) then becomes unopposed, and the left end of the intermediate latch lever drops downward, disengaging its intermediate latch shoulder 24*a* from intermediate latch pin 26. The clockwise moment on primary latch lever 14 previously exerted by force F2 is transposed to the now unrestrained clockwise moment of force F1 (FIG. 2) exerted on the primary latch lever by the charged breaker mechanism springs. The cradle is thus free to pivot the primary latch lever in the clockwise direction, thereby disengaging primary latch pin 20 from primary latch shoulder 12*a*. The cradle thus swings to its clockwisemost tripped position of FIG. 4 as the mechanism springs discharge. In the process, intermediate latch lever 24 is propelled leftward between latch pins 26 and 30; adequate clearance being afforded by relieving the intermediate latch lever edges leading rightwardly away from latch shoulders 24*a*, 24*b*, as indicated at 24*c* in FIG. 4. These edge reliefs terminate in stop shoulders 24*d* serving to limit the extent of leftward movement of the intermediate latch lever motivated by cradle 12. In its tripped position, the cradle provides a trailing edge 12*c* disposed to engage a pin 14*c* carried by the primary latch lever, as seen in FIG. 4, and thus maintain, against the contrary bias of latch reset spring 32 (FIG. 1), primary latch pin 20 in non-interfering relation with the cradle as it is being returned to its reset position.

When the cradle is returned to its reset position, its trailing edge 12*c* is in position to pick up primary latch pin 20 before clearing pin 14*c*. Thus, when the cradle is returned counterclockwise beyond its reset position and primary latch shoulder 12*a* swings below the primary latch pin, reset spring 32 pivots the primary latch lever in the counterclockwise direction to swing the primary latch pin into position to intercept primary latch shoulder 12*a* when the applied breaker charging and cradle resetting force is removed. Coincidentally, spring 32 returns secondary latch lever 28 to its clockwisemost position of FIG. 1; the trip solenoid having previously been reset to remove trip force F5.

To cooperate with torsion spring 34, seen in FIG. 1 to be exerting a clockwise bias on the intermediate latch lever, in properly positioning intermediate latch shoulder 24*a* relative to intermediate latch pin 26 during latch reset, a positioning shoulder 24*e* is formed in the intermediate latch lever immediately below the intermediate latch shoulder. Thus, for the brief interval during the breaker resetting operation from the time the primary latch pin swings into intercepting relation with the primary latch shoulder to the time the latch assembly assumes the burden of restraining the cradle in its reset position, the clockwise bias of spring 34 on the intermediate latch lever brings positioning shoulder 24*e* to bear against intermediate latch pin 26. The intermediate latch lever is thus correctly positioned to ensure that its intermediate latch shoulder 24*a* reliably engages the intermediate latch pin when the latch assembly is loaded up by the charged breaker mechanism springs.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. A trip latch assembly for releasably latching the pivotally mounted cradle of an automatic electric circuit breaker in a reset position against the bias of operating mechanism springs, said latch assembly comprising, in combination:

A. a primary latch lever pivotally mounted adjacent one of its ends by a first pivot pin and mounting adjacent its other end a primary latch pin for engaging a primary latch shoulder formed on the cradle to sustain the cradle in its reset position, the cradle exerting a first moment on said primary latch lever about said first pivot pin, said first moment having a relatively short first moment arm;

B. an intermediate latch lever pivotally mounted adjacent its one end by a second pivot pin carried by said primary latch lever, said intermediate latch lever including an intermediate latch shoulder and a secondary latch shoulder separately formed at its other end;

C. an intermediate latch pin fixedly positioned for engagement by said intermediate latch shoulder to translate said first moment to a second moment on said primary latch lever about said first pivot pin having a second moment arm at least several times greater than said first moment arm, the force component of said second moment being opposed by an equal and opposite force component of a third moment exerted on said intermediate latch lever about said second pivot pin and having a relatively short third moment arm;

D. a pivotally mounted secondary latch lever; and

E. a secondary latch pin carried by said secondary latch lever in position to engage said secondary latch shoulder to translate said third moment to a fourth moment on said intermediate latch lever about said second pivot pin having a fourth moment arm at least several times longer than said third moment arm, whereby an exceptionally light trip force exerted on said secondary latch is effective in swinging said secondary latch pin out of engagement with said secondary latch shoulder to then permit said intermediate latch shoulder to disengage said intermediate latch pin and, in turn, said primary latch pin to swing out of engagement with the cradle primary latch shoulder.

2. The latch assembly defined in claim 1, wherein said intermediate latch pin is constituted by a portion of a shaft pivotally mounting said secondary latch lever.

3. The latch assembly defined in claims 1 or 2, which further includes spring biasing means acting on said primary, intermediate and secondary latch levers to automatically orient same in their respective reset positions preparatory to relatching the cradle in its reset position upon being returned from its tripped position.

4. The latch assembly defined in claim 3, wherein said intermediate latch lever further includes a positioning shoulder formed therein at a location adjacent said intermediate latch shoulder, said spring means orienting said intermediate latch lever such as to bring said positioning shoulder to bear against said intermediate latch pin preparatory to relatching the cradle in its reset position, whereby to insure requisite latching engagement between said intermediate latch shoulder and said intermediate latch pin when said primary latch pin and said primary latch shoulder latchingly re-engage.

* * * * *